US006364445B1

(12) United States Patent
Ikeda et al.

(10) Patent No.: US 6,364,445 B1
(45) Date of Patent: Apr. 2, 2002

(54) IMAGE PRINTING APPARATUS AND METHOD

(75) Inventors: Takahisa Ikeda, Mishima; Atsushi Kubota, Shizuoka-ken; Hidehiro Watanabe, Tokyo; Megumi Shimizu, Mishima, all of (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/603,721

(22) Filed: Jun. 23, 2000

(30) Foreign Application Priority Data

Jun. 28, 1999 (JP) ..... 11-181920
Apr. 20, 2000 (JP) ..... 2000-118936

(51) Int. Cl.[7] ..... B41I 29/38
(52) U.S. Cl. ..... 347/14
(58) Field of Search ..... 347/43, 14, 15, 347/6, 84, 85, 54, 57

(56) References Cited

U.S. PATENT DOCUMENTS 5,608,438 A 3/1997 Koike et al.
5,870,112 A 2/1999 Kang et al.
6,084,610 A * 7/2000 Ozaki et al. ..... 347/43

FOREIGN PATENT DOCUMENTS

JP 6-239013 8/1994
JP 2752472 2/1998

* cited by examiner

*Primary Examiner*—N. Le
*Assistant Examiner*—K. Feggins
(74) *Attorney, Agent, or Firm*—Frishauf, Holtz, Goodman, Langer & Chick, P.C.

(57) ABSTRACT

An image printing apparatus comprises a storage section and a control section. The storage section stores an absorbing speed information in a storage area, the absorption speed information is a measured speed at which a recording medium used for a printing process absorbs an ink used for the printing process. And the control section controls an ink head so as to perform first dot recording which records a plurality of dots on the recording medium by a pitch of an ink ejection opening of the ink head, and moves the recording medium relatively with the ink head and controls the ink head so as to perform second dot recording which records a plurality of dots between a plurality of dots recorded by first dot recording, in accordance with a print interval time determined based on the absorption speed information stored in the storage section.

8 Claims, 5 Drawing Sheets

PLEASE SELECT PAPER NO. TO BE USED

| PAPER NO. | PRINT INTERVAL TIME |
|---|---|
| PAPER NO. 1 | 1.5sec |
| → PAPER NO. 2 | 3.0sec |
| PAPER NO. 3 | 5.0sec |
| PAPER NO. 4 | 0.5sec |
| PAPER NO. 5 | 3.0sec |
| PAPER NO. 6 | 1.0sec |

IMAGE PRINTING APPARATUS AND METHOD

CROSS-REFERENCE TO RELATED APPLICATIONS

This application is based upon and claims the benefit of priority from the prior Japanese Patent Applications No. 11-181920, filed Jun. 28, 1999; and No. 2000-118936, filed Apr. 20, 2000, the entire contents of which are incorporated herein by reference.

BACKGROUND OF THE INVENTION

The present invention relates to an ink jet recording method for carrying out dot recording at a pitch smaller than that between ink ejection openings of an ink jet recording head.

An ink jet recording head comprises a plurality of ink jet chambers each having an ink ejection opening that ejects an ink, a common ink chamber for feeding the ink into each of the ink chambers, and an ejection energy generator for causing the ink in the ink chamber to be ejected through the ink ejection opening. Known ejection energy generators include a piezoelectric member that varies the volume of the ink chamber to eject the ink through the ink ejection opening and an electrothermal conversion element that instantaneously partly evaporates the ink in the ink chamber to generate bubbles in order to vary the volume of the ink chamber, thereby ejecting the ink through the ink ejection opening. The ink ejected through the ink ejection opening is deposited on, absorbed by, and fixed to a recording medium such as paper or a film, as dots.

To increase the recording speed of such an ink jet recording head, the head is desirably elongated in a line direction correspondently to the width of the recording media, with a large number of ink ejection openings arranged at a small pitch. If, however, a large number of ejection openings are arranged at a small pitch, forming all the ink ejection openings so as to have the same pitch, the same height, and the same diameter requires a relatively high accuracy and is thus difficult to achieve. If this is feasible, the ink jet recording head will be very expensive and impractical. In addition, the ink ejection openings are likely to be blocked to degrade recorded images.

Thus, the pitch between the ink ejection openings is increased, and the first dot recording on recording media is carried out at this pitch between the ink ejection openings. Then, for the second dot recording, the recording head is moved, for example, in the line direction a distance corresponding to half of the pitch between the ink ejection openings so that each ink ejection opening is located midway between the last positions of the ink ejection openings, thereby enabling high-resolution images to be recorded at the pitch half that of the ink ejection openings. Higher-resolution images can be recorded by moving the recording head a distance corresponding to one third or one fourth of the ink ejection opening pitch. In this case, however, recording is repeated on the same recording medium three or four times, thereby reducing printing speed.

If, however, high-resolution images are recorded by shifting the dot recording on the same recording medium in the line direction, there will be a difference in density arising from a difference in time between the first printing and subsequent printings, resulting in a stripe pattern on the recording medium in a direction orthogonal with the line direction to degrade image quality.

BRIEF SUMMARY OF THE INVENTION

It is an object of the present invention to provide an ink jet printing apparatus and method for recording images by shifting a head position in a line direction with respect to a recording medium while repeating dot recording a plurality of times, wherein printing is carried out a plurality of times using a print interval time determined by referencing an ink absorbing speed of recording media, to prevent occurrence of a stripe pattern caused by a difference in time associated with repeated printing, thereby enabling high-quality image recording.

Present invention provides an image printing apparatus comprises storage means for storing an absorbing speed information in a storage area, the absorption speed information is a measured speed at which a recording medium used for a printing process absorbs an ink used for the printing process; and control means for controlling an ink head so as to perform first dot recording which records a plurality of dots on the recording medium by a pitch of an ink ejection opening of the ink head, and for moving the recording medium relatively with the ink head and controlling the ink head so as to perform second dot recording which records a plurality of dots between a plurality of dots recorded by first dot recording, in accordance with a print interval time determined based on the absorption speed information stored in the storage means.

The present invention is based on new experiments with jet printers and data obtained therefrom; it is also based on the discovery and confirmation of a reproducible correlationship between a print interval time margin for preventing occurrence of a stripe pattern caused by a difference in printing time during dot printing carried out in a plurality of operations and the nature of recording media (paper) used for this printing (specifically, the speed at which the inks used are absorbed by the paper used).

Before present invention, the inventor thought, in the printing carried out by the jet printer in a plurality of operations, the possibility of a stripe pattern occurring decreases with increasing difference in printing time between the first printing and subsequent printing. Setting an extremely short print interval time, however, reduces design margins to cause unstable operations. Accordingly, the print interval time for the plurality of printing operations must be relatively long so that no stripe pattern will occur.

Then, based on analysis of an enormous amount of experiments and resulting information, the inventor has discovered a positive reproducible relationship between the speed at which the inks used are absorbed by the recording paper used and the print interval time appropriate for avoiding the occurrence of a stripe pattern. That is, a margin for the occurrence of a stripe pattern increases consistently with the ink absorption speed. And, the margin increases inversely with the printing interval time. The relationship between the (ink absorbing time of the paper) and the (print interval time) is specific, stable, and reproducible enough to be expressed by an inequality using fixed constants.

If printing is carried out in a plurality of operations by using this relationship to set an optimal print interval time for recording paper to be used, the largest margin is obtained while preventing the occurrence of a stripe pattern. Thus, the present invention can provide an image printing apparatus and method that can prevent the occurrence of a stripe pattern while stabilizing printing operations.

The relationship between the (ink absorption speed of the paper) and the (print interval time) can be expressed using specific values. Accordingly, by determining the (print interval time) based on these values to perform a plurality of printing operations, a more reliable image printing apparatus and method can be implemented.

Furthermore, since the ink absorbing speed has a relationship with the temperature of the ink, a more sophisticated and stable image printing apparatus and method can be realized by measuring the current ink temperature in the image printing apparatus and determining the print interval time taking a result of the measurement into consideration.

Additional objects and advantages of the invention will be set forth in the description which follows, and in part will be obvious from the description, or may be learned by practice of the invention. The objects and advantages of the invention may be realized and obtained by means of the instrumentalities and combination particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

Embodiments of the present invention will be explained with reference to the drawings. In these embodiments, the present invention is applied to an ink jet recording head that uses a piezoelectric member as an ejection energy generator.

Figure 1:
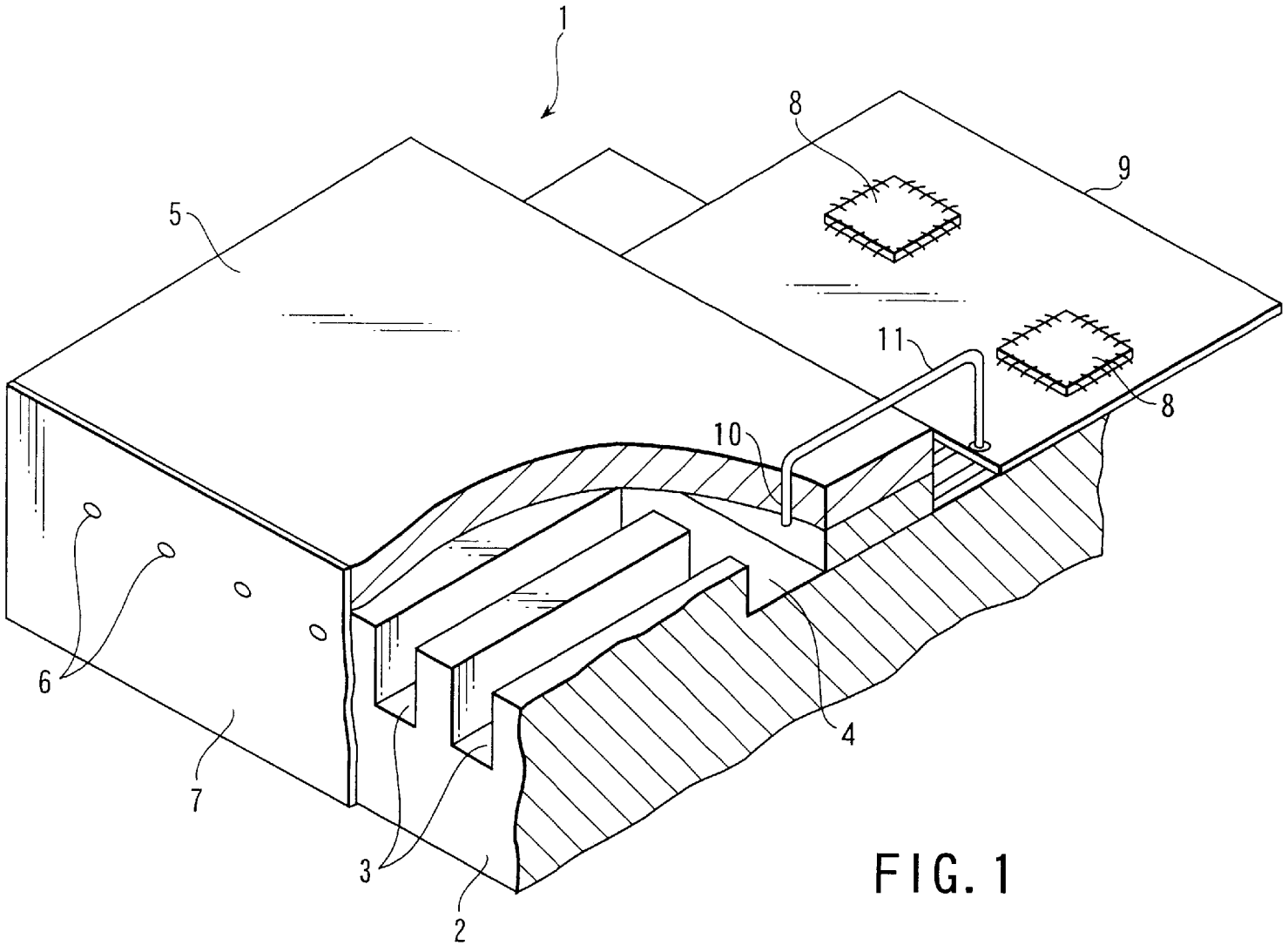
FIG. 1 is a partially cutaway perspective view of an ink jet recording head showing an embodiment of the present invention.

FIG. 1 is a partially cutaway perspective view showing the configuration of an ink jet recording head 1. A substrate 2 comprising a piezoelectric member has its top portion cut so as to form a large number of elongated grooves at a predetermined pitch, the grooves forming ink chambers 3. A common ink chamber 4 is formed behind the ink chambers 3 for supplying an ink to the ink chambers 3. The ink chambers 3 and the common ink chamber 4 have their top portions closed by a roof 5, and an orifice plate 7 is bonded and fixed to the ink chambers 3 at their front ends and has ink ejection openings 6 each formed therein in a central portion of a corresponding one of the ink chambers 3.

A circuit substrate 9 is fixed to the substrate 2 behind it and has drive circuit components arranged thereon. The roof 5 has a hole formed therein at a position over the common ink chamber 4 and into which a thermocouple temperature sensor 10 is inserted and fixed with an ink resisting adhesive. The thermocouple temperature sensor 10 has its tip located in contact with the ink in the common ink chamber 4 and protected by an ink resisting member. The thermocouple temperature sensor 10 has its rear end connected to a predetermined circuit section of the circuit board 9 via a lead. Walls are arranged so as to sandwich each of the ink chambers 3 therebetween and each have an electrode thereon.

In the ink jet recording head 1, an ejection energy generator comprises a piezoelectric member. A potential difference is applied between the electrodes on opposed surfaces of the two walls constituting partition walls for each ink chamber 3 to deform the piezoelectric member constituting both walls, thereby varying the volume of the desired ink chamber to eject the ink through the ink ejection opening 6.

Figure 2:
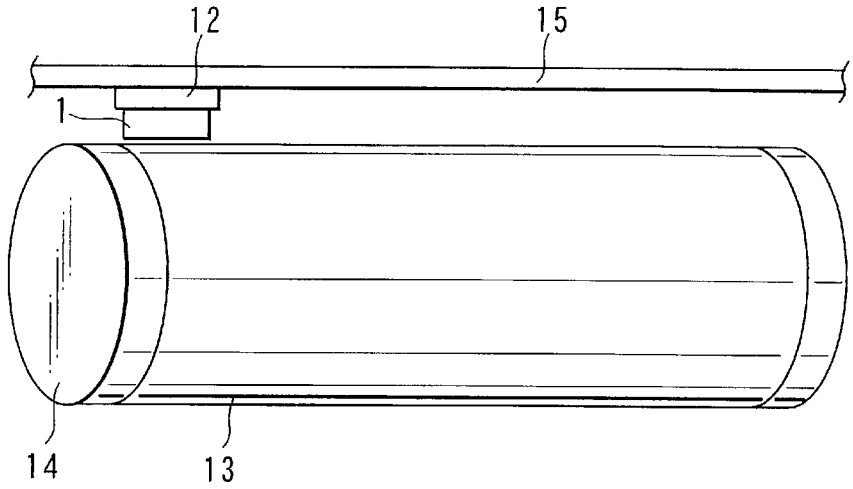
FIG. 2 is a view showing a locational relationship between an ink jet recording head and a recording medium according to the embodiment.

As shown in FIG. 2, the ink jet recording head 1 is fixed to a carriage 12, which is then movably installed on a guide rail 15 located in the direction of a rotational axis of a rotating drum 14 around which a recording medium 13 is wound.

The ink jet recording head 1 has a length corresponding to a fraction of the width of the recording medium. When the rotating drum 14 makes the first rotation, dot recording is carried out at the pitch of the ink ejection openings 6 in the recording head 1. On the second rotation, before dot recording, the carriage 12 moves on the guide rail 15 to shift the recording head 1 a distance equal to half of the pitch between the ink ejection openings so that each ink ejection opening 6 is situated midway between the positions of the corresponding ink ejection openings which are set during the last dot recording. This operation is repeated several times while moving the recording head 1 a distance corresponding to the width thereof, thereby recording an image over the width of the single recording medium 13.

Thus, if the ink jet recording head 1 has a recording density of 150 dpi, this apparatus can record images on the recording medium 13 at a high-resolution recording density of 300 dpi.

The rotating drum 14 has a diameter of, for example, 129 mm. Consequently, the rotating drum 14 moves $\pi \times 129$ mm=405 mm during one rotation.

And in other method (not shown on FIG.), when the line head of the long type, which has record width same as the record width of the recording medium, is used instead of the recording head 1, at first rotation, dot recording is performed by a pitch of the ink ejection openings of the line head. Then, at second rotation, dot recording are performed between each dot printed already at first rotation, by shifting the line head by ½ of the ink ejection openings of the line head, thereby, predetermined recording density would be realized. In this case, it is possible that the recording method is fixing the recording medium and shifting and scanning the line head relatively against the recording medium.

Figure 3:
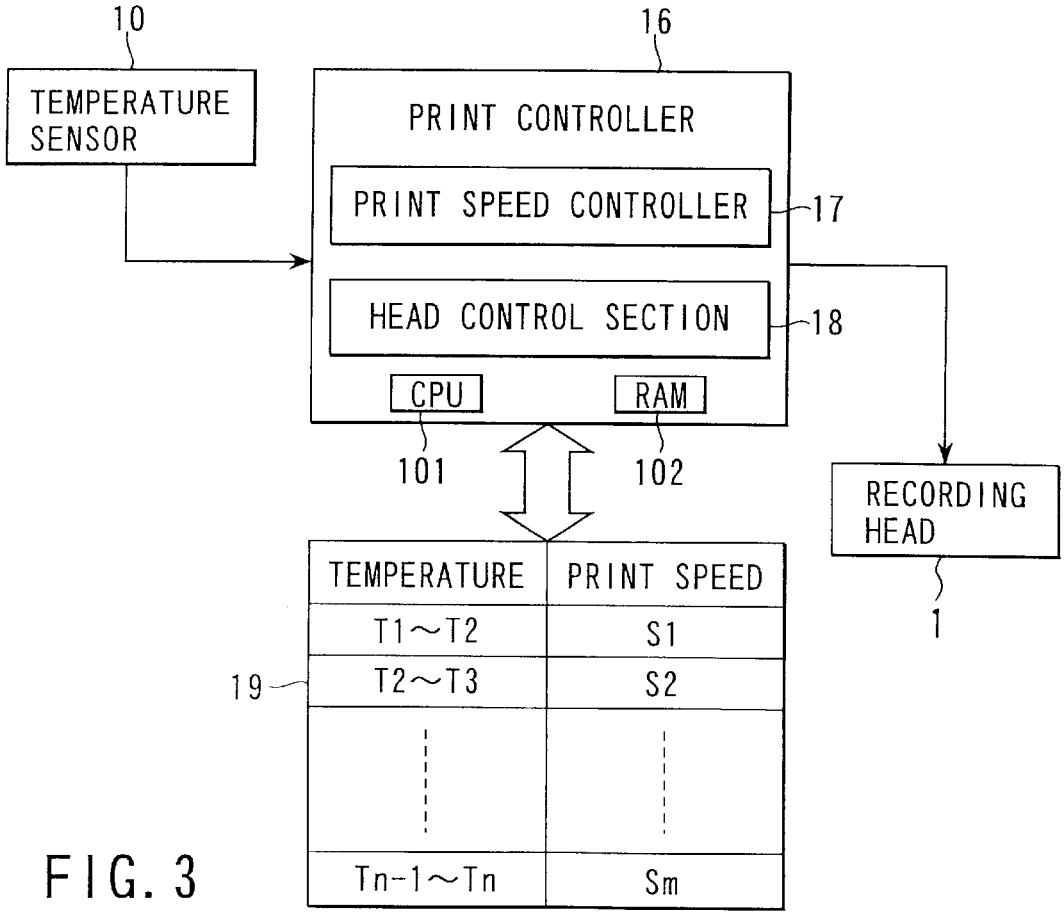
FIG. 3 is a block diagram showing the configuration of a control section according to the embodiment.

FIG. 3 is a block diagram showing the configuration of a control section. This figure shows a print controller 16 comprising a print speed controller 17, a head control section 18, a CPU 101 for unifying operations, and a RAM 102 for storing data on the relationship between (ink absorbing speed of the paper) and (print interval time), which is characteristic of the present invention. When the print controller 16 loads a temperature detection signal from the temperature sensor 10, the print speed controller 17 reads out from a temperature table 19 a print speed corresponding to the detected temperature to control rotation of the rotating drum 14 and movement of the recording head 1 based on this print speed. The head control section 18 then drives the recording head 1 based on print data to record an image on the recording medium 13.

With this apparatus, the relationship between the print speed and occurrence of a stripe pattern with a variable density was examined by using various types of commercially available recording paper as the recording media 13 and using as the ink an oily pigment ink comprising a petroleum-based solvent and a pigment dispersed therein. The oily pigment ink was selected to have a viscosity between 5 and 18 cps and a surface tension between 26 and 30 mN at an ink temperature between 10 and 50° C.; results of tests showed that the selected ink actually had an ink temperature of 35° C., a viscosity of 7 cps, and a surface tension of 27 mN/m.

When commercially available recording paper sample Nos. 1 to 7 were tested by varying the peripheral speed of the rotating drum 14 between 10 and 811 mm/s, the results shown in Table 1 were obtained. In the table, circles indicate that no stripe pattern occurred, while crosses indicate that a stripe pattern occurred.

The results show that a stripe pattern occurred on the recording paper sample No. 1 at a print speed of 135 mm/s or lower, that a stripe pattern occurred on the recording paper sample No. 2 at a print speed of 101 mm/s or lower, that a stripe pattern occurred on the recording paper sample No. 3 at a print speed of 58 mm/s or lower, that a stripe pattern occurred on the recording paper sample No. 4 at a print speed of 406 mm/s or lower, that a stripe pattern occurred on the recording paper sample No. 5 at a print speed of 811 mm/s or lower, that a stripe pattern occurred on the recording paper sample No. 6 at a print speed of 101 mm/s or lower, and that a stripe pattern occurred on the recording paper sample No. 7 at a print speed of 406 mm/s or lower.

In addition, since the rotating drum 14 moves 405 mm during one rotation, the peripheral speed of the rotating drum 14 can be converted into a rotational period, that is, a print interval time between 0.5 and 40 seconds. Thus, the print speeds in Table 1 can be substituted with print interval times, which are shown in Table 2. In the table, circles indicate that no stripe pattern occurred, triangles indicate that only a few stripes were observed, and crosses indicate that a significant stripe pattern occurred.

The results show that a stripe pattern occurred on the recording paper sample No. 1 when the print interval time became shorter than 3 seconds, that a stripe pattern occurred on the recording paper sample No. 2 when the print interval time became shorter than 4.5 seconds, that a stripe pattern occurred on the recording paper sample No. 3 when the print interval time became shorter than 7 seconds, that a stripe pattern occurred on the recording paper sample No. 4 when the print interval time became shorter than 1.5 seconds, that a stripe pattern occurred on the recording paper sample No. 5 when the print interval time became shorter than 0.5 seconds, that a stripe pattern occurred on the recording paper sample No. 6 when the print interval time became shorter than 4.5 seconds, and that a stripe pattern occurred on the recording paper sample No. 7 when the print interval time became shorter than a 1.5 seconds.

TABLE 1

| | PRINT SPEED (mm/s) | | | | | | | | | | | | | | | | |
|---|---|---|---|---|---|---|---|---|---|---|---|---|---|---|---|---|---|
| SAMPLE | 811 | 406 | 270 | 203 | 162 | 135 | 116 | 101 | 90 | 81 | 68 | 58 | 51 | 45 | 41 | 20 | 10 |
| No. 1 | ○ | ○ | ○ | ○ | ○ | × | × | × | × | × | × | × | × | × | × | × | × |
| No. 2 | ○ | ○ | ○ | ○ | ○ | ○ | ○ | × | × | × | × | × | × | × | × | × | × |
| No. 3 | ○ | ○ | ○ | ○ | ○ | ○ | ○ | ○ | ○ | ○ | ○ | × | × | × | × | × | × |
| No. 4 | ○ | × | × | × | × | × | × | × | × | × | × | × | × | × | × | × | × |
| No. 5 | × | × | × | × | × | × | × | × | × | × | × | × | × | × | × | × | × |
| No. 6 | ○ | ○ | ○ | ○ | ○ | ○ | ○ | × | × | × | × | × | × | × | × | × | × |
| No. 7 | ○ | × | × | × | × | × | × | × | × | × | × | × | × | × | × | × | × |

TABLE 2

| SAMPLE/ PRINT INTERVAL TIME (s) | 0.5 | 1.0 | 1.5 | 2.0 | 2.5 | 3.0 | 3.5 | 4.0 | 4.5 | 5.0 | 6.0 | 7.0 | 8.0 | 9.0 | 10.0 | 20.0 | 40.0 | ABSORBING SPEED [pl/ms] |
|---|---|---|---|---|---|---|---|---|---|---|---|---|---|---|---|---|---|---|
| No. 1 | ○ | ○ | ○ | Δ | Δ | Δ | × | × | × | × | × | × | × | × | × | × | × | 5.60 |
| No. 2 | ○ | ○ | ○ | ○ | ○ | ○ | Δ | Δ | Δ | × | × | × | × | × | × | × | × | 10.24 |
| No. 3 | ○ | ○ | ○ | ○ | ○ | ○ | ○ | ○ | ○ | ○ | Δ | Δ | × | × | × | × | × | 43.75 |
| No. 4 | ○ | Δ | Δ | × | × | × | × | × | × | × | × | × | × | × | × | × | × | 2.80 |
| No. 5 | Δ | × | × | × | × | × | × | × | × | × | × | × | × | × | × | × | × | 1.56 |
| No. 6 | ○ | ○ | ○ | ○ | ○ | ○ | Δ | Δ | Δ | × | × | × | × | × | × | × | × | 12.35 |
| No. 7 | ○ | ○ | Δ | × | × | × | × | × | × | × | × | × | × | × | × | × | × | 3.23 |

Next, the recording paper used in the above tests was tested for ink permeability. Although there are various methods for measuring ink permeability, the time required for one ink droplet ejected from the ink ejection opening to be absorbed by the recording paper after landing thereon was measured and expressed in terms of the absorbing speed.

Figures 4, 7:
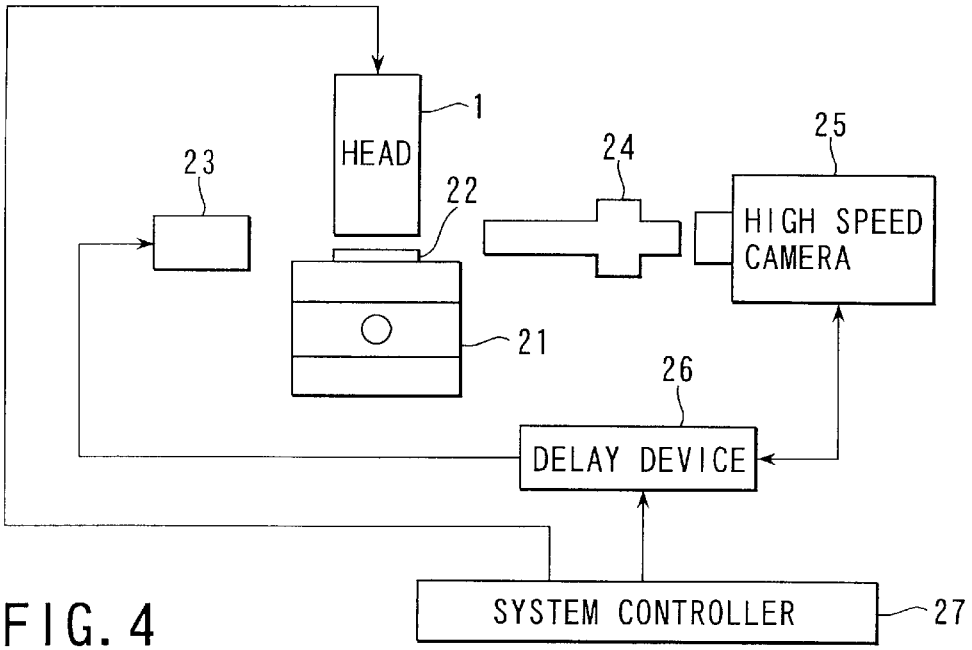
FIG. 4 is a block diagram showing the configuration of a test device for use in the embodiment.
FIG. 7 is a view showing a setting screen of a printing apparatus using the ink jet recording head according to the present invention.

FIG. 4 is a block diagram showing the configuration of a test apparatus. Sample recording paper 22 is placed on an X-Y-Z stage 21 and an ink droplet was fired onto the recording paper 22 from the ink jet recording head 1. In addition, a stroboscope 23 flashes at an ink landing portion on the recording paper 22, and a high speed camera photographs the ink landing portion through an optical microscope. Specifically, photographs are taken of the ink and its surroundings as it is ejected by the recording head 1, subsequently lands on the recording paper 22, and is then absorbed thereby, while a delay device 26 is adjusting a delay time to determine light emission timings for the stroboscope 23 and photographing timings for the high speed camera; these controls are provided by a system controller 27.

Then, the time from the landing of the ink droplet on the recording paper 22 until the former is absorbed by the latter is determined from the photographs taken by the high speed camera 25, to calculate the ink absorbing speed. Results of this test are shown in Table 3. In this table, circles indicate that the ink is present in the recording paper and that its absorption has not completed, while crosses indicate that the absorption has completed.

The results show that with the recording paper sample No. 1, the absorption completed in 7.5 ms indicating that the absorption speed was 5.6 pl/ms, that with the recording paper sample No. 2, the absorption completed in 4.1 ms indicating that the absorption speed was 10.24 pl/ms, that with the recording paper sample No. 3, the absorption completed in 0.96 ms indicating that the absorption speed was 43.75 pl/ms, that with the recording paper sample No. 4, the absorption completed in 15 ms indicating that the absorption speed was 2.80 pl/ms, that with the recording paper sample No. 5, the absorption completed in 27 ms indicating that the absorption speed was 1.56 pl/ms, that with the recording paper sample No. 6, the absorption completed in 3.4 ms indicating that the absorption speed was 12.35 pl/ms, and that with the recording paper sample No. 7, the absorption completed in 13 ms indicating that the absorption speed was 3.23 pl/ms.

TABLE 3

| | TIME (ms) | | | | | | | | | | | | | | | | |
|---|---|---|---|---|---|---|---|---|---|---|---|---|---|---|---|---|---|
| SAMPLE | 0.1 | 0.2 | 0.4 | 0.8 | 1 | 1.5 | 2 | 3 | 4 | 5 | 10 | 15 | 20 | 25 | 30 | 35 | 40 |
| No. 1 | ○ | ○ | ○ | ○ | ○ | ○ | ○ | ○ | ○ | ○ | × | × | × | × | × | × | × |
| No. 2 | ○ | ○ | ○ | ○ | ○ | ○ | ○ | ○ | ○ | × | × | × | × | × | × | × | × |
| No. 3 | ○ | ○ | ○ | ○ | × | × | × | × | × | × | × | × | × | × | × | × | × |
| No. 4 | ○ | ○ | ○ | ○ | ○ | ○ | ○ | ○ | ○ | ○ | ○ | × | × | × | × | × | × |
| No. 5 | ○ | ○ | ○ | ○ | ○ | ○ | ○ | ○ | ○ | ○ | ○ | ○ | ○ | ○ | × | × | × |
| No. 6 | ○ | ○ | ○ | ○ | ○ | ○ | ○ | ○ | × | × | × | × | × | × | × | × | × |
| No. 7 | ○ | ○ | ○ | ○ | ○ | ○ | ○ | ○ | ○ | ○ | ○ | × | × | × | × | × | × |

For the relationship between the print speed and absorbing speed obtained for each recording paper 22 sample, when the print speed is expressed in terms of T millimeters per second (hereafter referred to as "mm/s") and the ink absorbing speed is expressed in terms of t picolitter per millisecond (hereafter referred to as "pl/ms"), the boundary between an area where a stripe pattern occurs and an area where only a few stripes, if any, occur can be expressed by:

$$T=888\times t^{-0.82} \quad (1)$$

Accordingly, to carry out printing while preventing occurrence of a stripe pattern arising from a difference in density, a set print speed $T_x$(mm/s) may be $T_x>T$, that is:

$$T_x>888\times t^{-0.82} \quad (2)$$

Figure 5:
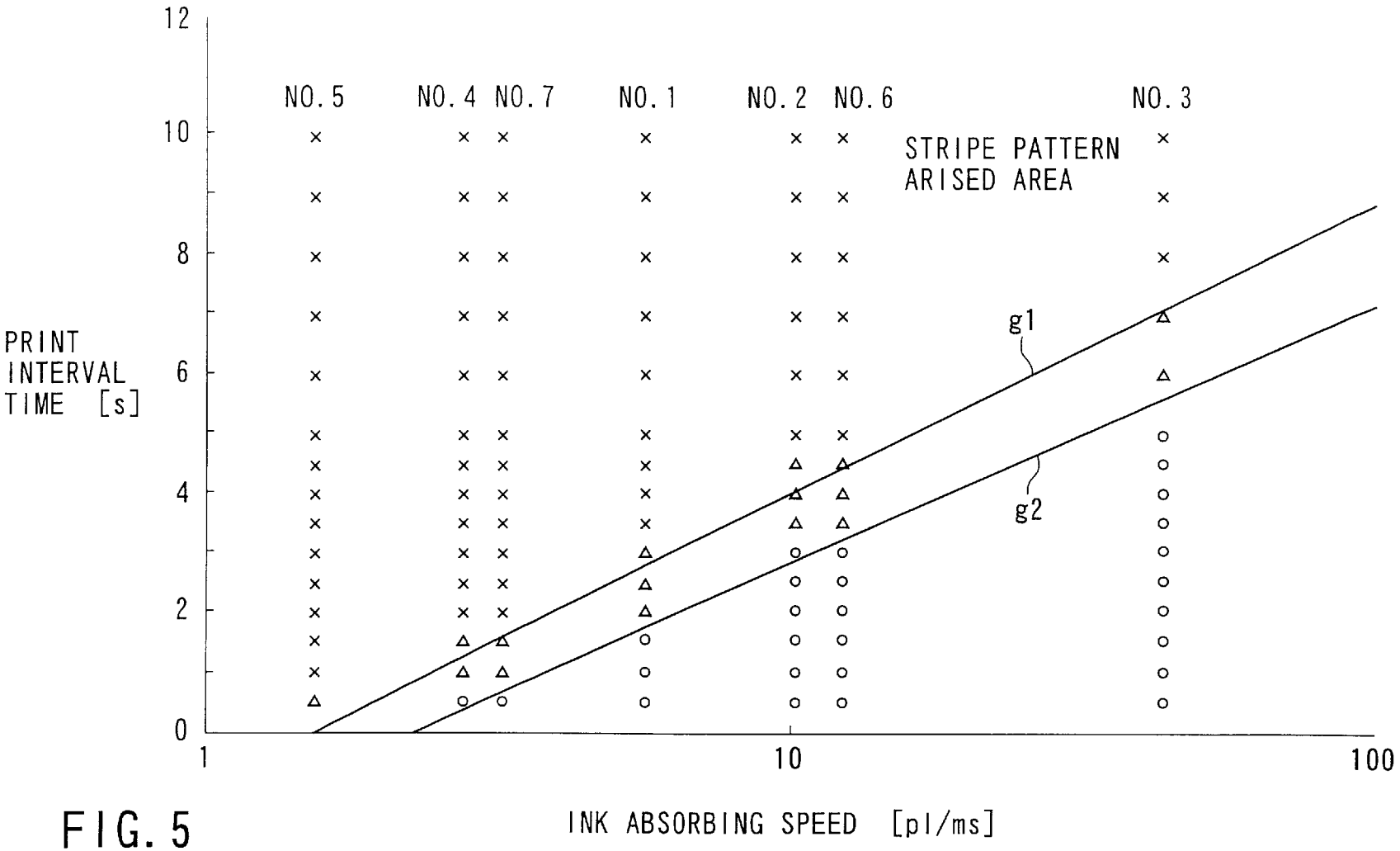
FIG. 5 is a graph showing tests results according to the embodiment.

The above results are shown in terms of the relationship between the print speed and the ink absorbing speed for each recording paper 22 sample, but when the print speeds are converted into print interval times based on the fact that the rotating drum 14 moves 405 mm during one rotation, the relationship between the print interval time and the ink absorbing speed is shown by the distribution shown in FIG. 5. When the print interval time is expressed in terms of U seconds (hereafter referred to as "s") and the ink absorbing speed is expressed in terms of t (pl/ms), the boundary between an area where a stripe pattern occurs and an area where only a few stripes, if any, occur can be expressed by:

$$U=2.04\times t^{-0.87} \quad (3)$$

as shown by the graph $g_1$ in the figure.

Thus, to carry out printing while preventing the occurrence of a stripe pattern originating from a difference in density, the relationship between the print interval time U(s) and the ink absorbing speed t(pl/ms) must be in an area below the graph $g_1$, and a set print interval time $U_x$(s) may be $U_x<U$, that is, $$U_x<2.04\times t^{-0.87} \quad (4)$$

In Equation (4), if stripes occur but only a few do, they are considered to be equivalent to the absence of a stripe pattern. If, however, an area where only a few stripes occur is included in an area where a stripe pattern occurs in order to reliably prevent the occurrence of a stripe pattern, the boundary between the area where a stripe pattern occurs and the area where no stripe pattern occurs can be expressed by:

$$U=1.9\times t^{-1.57} \quad (5)$$

as shown by the graph $g_2$ in the figure.

Consequently, to carry out printing while preventing the occurrence of a stripe pattern stemming from a difference in density, the relationship between the print interval time U(s) and the ink absorbing speed t(pl/ms) must be in an area below the graph $g_2$, and a set print interval time $U_x$(s) may be $U_x<U$, that is, $$U_x<1.9\times t^{-1.57} \quad (6)$$

Thus, with the condition in the above Equation (4) met, no stripe pattern occurs if the ink jet recording head 1 has the ink ejection openings 6 arranged at a pitch of 150 dpi and if this recording head 1 has its movement controlled to record images on various types of recording paper at a recording density of 300 dpi. That is, high-resolution images can be recorded without degrading print quality. Furthermore, with the condition in the above Equation (6) met, the occurrence of a stripe pattern can be prevented more reliably to record higher-resolution images.

In addition, the inks are known to have their physical properties such as viscosity and surface tension varied by temperature, thereby varying the ink absorbing speed. In general, as the temperature increases, the ink viscosity and surface tension decrease, while the ink absorbing speed increases. On the contrary, as the temperature decreases, the ink viscosity and surface tension increase, while the ink absorbing speed decreases. Furthermore, the likelihood that a stripe pattern with a variable density occurs on the recording paper increases with decreasing ink absorbing speed, as is apparent from FIG. 5.

Accordingly, at the same print speed, a stripe pattern with a variable density is more likely to occur at lower ink temperature. In other words, at low ink temperature, the print speed must be increased.

In this case, the thermocouple temperature sensor 10 is used to detect the temperature of the ink in the common ink chamber 4. Additionally, the temperature table 19 is provided so that the print interval time $U_x$ corresponding to each temperature level can be set in this table 19 so as to meet the relationship $$U_x<2.04\times t^{-0.87}.$$

The print speed controller 17 of the print control section 16 selectively reads out an print interval time from the temperature table 19 depending on the detected ink temperature from the thermocouple temperature sensor 10, and the head control section 18 drives and controls the ink jet recording head 1 based on the read-out print interval time.

Consequently, despite a variation in temperature of the ink in the common ink chamber 4, the relationship between the print interval time $U_x$ (mm/s) and the ink absorbing speed t(pl/ms) constantly meets $U_x<2.04\times t^{-0.87}$, thereby enabling high-resolution images to be recorded without a stripe pattern despite a variation in ink temperature, that is, without degrading print quality.

In addition, by setting the print interval time $U_x$ corresponding to each temperature level in the temperature table 19 so as to meet the relationship $U_x<1.9\times t^{-1.57}$, the relationship between the print interval time $U_x$ (mm/s) and the ink absorbing speed t(pl/ms) constantly meets $U_x<1.9\times t^{-1.57}$, thereby reliably preventing the occurrence of a stripe pattern despite a variation in ink temperature to enable higher-resolution images to be recorded.

In the ink jet recording apparatus according to the present invention, an operation screen such as that shown in FIG. 7 is used to store in the RAM 102 data on plural pieces of paper and print interval times optimal therefor as described above. A user operates the apparatus to select, for example, paper No. 2 to determine the print interval time corresponding to this paper (in this case, 3.0 sec.). These operations by the user automatically determine the print interval time optimal for the current paper, enabling high-quality print images to be stably obtained while providing such a margin that no stripe pattern occurs.

Figure 6:
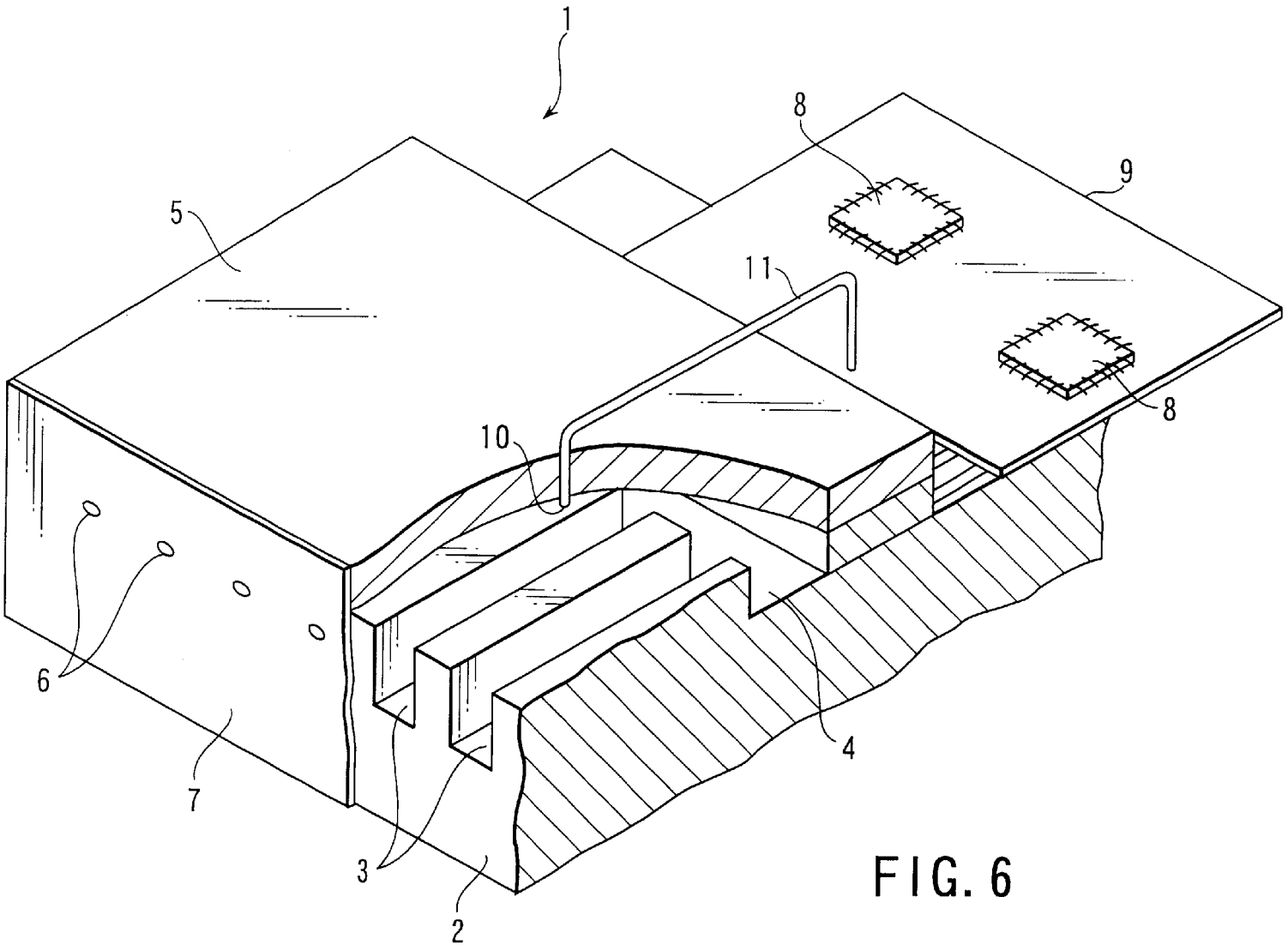
FIG. 6 is a partially cutaway perspective view of an ink jet recording head showing another embodiment of the present invention.

Although the above described embodiment locates the thermocouple temperature sensor 10 in the roof 5 on the common ink chamber 4 to directly detect the ink temperature, the present invention is not limited to this but a hole may be formed in the roof 5 at a site in contact with the piezoelectric member constituting the ejection energy generator acting as a drive source so that the thermocouple temperature sensor 10 can be inserted into this hole to bring its tip into contact with the piezoelectric member to detect temperature thereof, as shown in FIG. 6. That is, the piezoelectric member is deformed when a voltage is applied, to vary the volume of the ink chamber 3 in order to generate heat. This heat is transmitted to the ink in the ink chamber 3 to increase the ink temperature. Thus, the increase in temperature of the piezoelectric member corresponds to the increase in ink temperature, so that the ink temperature can be indirectly detected by detecting the temperature of the piezoelectric temperature. In addition, although the above described embodiment uses the thermocouple temperature sensor as the temperature sensor, of course the present invention is not limited to this.

In the above described embodiment, the ink jet recording head has the ink ejection openings arranged at a pitch of 150 dpi and has its movement controlled so that one dot is further printed between the ink ejection openings, so as to print high resolution of 300 dpi. The present invention, however, is not limited to this. For example, same effect may be obtain by that it uses the ink jet recording head having the pitch of the ink ejection openings being 300 dpi, and the recording head would be moved and controlled so that more dots are further printed between the ink ejection openings and realizes high resolution image recording so as to attain printing by 600 dpi.

Additionally, in the above described embodiment, the present invention is applied to the type of ink jet recording head which uses the piezoelectric member as the ejection energy generator. The present invention, however, is not limited to this but is applicable to a type of ink jet recording head, and so on, which uses as the ejection energy generator an electrothermal conversion element such as a heating resistor.

Further, present invention can be applied to the case that the recording is performed by fixing the recording medium and shifting and scanning the line head of the long type relatively against the recording medium.

As described above in detail, the present invention can provide the image printing apparatus and method for recording images by shifting the head position in the line direction with respect to the same recording medium while repeating dot recording a plurality of times, in order to record high-resolution images, wherein printing is carried out in a plurality of operations using the print interval time based on the information on the speed at which the ink used for printing is absorbed by the recording medium used for printing, to prevent the occurrence of a stripe pattern resulting from a difference in printing time, thereby enabling high-resolution image recording.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An image printing apparatus comprising:

storage means for storing absorbing speed information representing a speed at which a recording medium used for a printing process absorbs an ink used for the printing process; and control means for controlling an ink head so as to perform a first dot recording which records a plurality of first dots on the recording medium by a pitch of an ink ejection opening of the ink head, and for moving the ink head relative to the recording medium and controlling the ink head so as to perform a second dot recording which records a plurality of second dots between the plurality of first dots recorded by the first dot recording, in accordance with a print interval time determined to meet the relationship:

$$U_x<2.04\times t^{-0.87}(\text{where } U_x>0)$$

between the speed at which the recording medium absorbs the ink ejected from the ink head and the print interval time between the first dot recording and the second dot recording when the speed is defined as t (picoliters per millisecond) and when the print interval time is defined as $U_x$ (seconds) based on the absorption speed information stored in the storage means.

2. An image printing apparatus according to claim 1, wherein the control means includes means for measuring a temperature of the ink supplied to the ink head.

3. An image printing apparatus comprising:

storage means for storing absorbing speed information representing a speed at which a recording medium used for a printing process absorbs an ink used for the printing process; and control means for controlling an ink head so as to perform a first dot recording which records a plurality of first dots on the recording medium by a pitch of an ink ejection opening of the ink head, and for moving the ink head relative to the recording medium and controlling the ink head so as to perform a second dot recording which records a plurality of second dots between the plurality of first dots recorded by the first dot recording, in accordance with a print interval time determined to meet the relationship:

$$U_x<1.9\times t^{-1.57}(\text{where } U_x>0)$$

between the speed at which the recording medium absorbs the ink ejected from the ink head and the print interval time between the first dot recording and the second dot recording when the speed is defined as t (picoliters per millisecond) and when the print interval time is defined as $U_x$ (seconds) based on the absorption speed information stored in the storage means.

4. An image printing apparatus according to claim 3, wherein the control means includes means for measuring a temperature of the ink supplied to the ink head.

5. An image printing method comprising:

storing information on a measured speed at which a recording medium used for a printing process absorbs an ink used for the printing process; and controlling an ink head so as to perform a first dot recording which records a plurality first of dots on the recording medium by a pitch of an ink ejection opening of the ink head, and for moving the ink head relative to the recording medium and controlling the ink head so as to perform a second dot recording which records a plurality of second dots between the plurality of first dots recorded by the first dot recording, in accordance with a print interval time determined to meet the relationship:

$$U_x<2.04\times t^{-0.87}(\text{where } U_x>0)$$

between the speed at which the recording medium absorbs the ink ejected from the ink head and the print interval time between the first dot recording and the second dot recording when the speed is defined as t (picoliters per millisecond) and when the print interval time is defined as $U_x$ (seconds) based on the stored absorption speed information.

6. An image printing method according to claim 5, wherein the control step includes a step of measuring a temperature of the ink supplied to the ink head.

7. An image printing method comprising:

storing information on a measured speed at which a recording medium used for a printing process absorbs an ink used for the printing process; and controlling an ink head so as to perform a first dot recording which records a plurality first of dots on the recording medium by a pitch of an ink ejection opening of the ink head, and for moving the ink head relative to the recording medium and controlling the ink head so as to perform a second dot recording which records a plurality of second dots between the plurality of first dots recorded by the first dot recording, in accordance with a print interval time determined to meet the relationship:

$$U_x<1.9\times t^{-1.57}(\text{where } U_x>0)$$

between the speed at which the recording medium absorbs the ink ejected from the ink head and the print interval time between the first dot recording and the second dot recording when the speed is defined as t (picoliters per millisecond) and when the print interval time is defined as $U_x$ (seconds) based on the stored absorption speed information.

8. An image printing method according to claim 7, wherein the control step includes a step of measuring a temperature of the ink supplied to the ink head.

* * * * *